US010852115B2

(12) United States Patent
Neill

(10) Patent No.: US 10,852,115 B2
(45) Date of Patent: Dec. 1, 2020

(54) STORAGE SYSTEM AND METHOD

(71) Applicant: Rodney Neill, Turners Falls, MA (US)

(72) Inventor: Rodney Neill, Turners Falls, MA (US)

(73) Assignee: Rodney Neill, Turners Falls, MA (US)

( * ) Notice: Subject to any disclaimer, the term of this patent is extended or adjusted under 35 U.S.C. 154(b) by 463 days.

(21) Appl. No.: 15/477,162

(22) Filed: Apr. 3, 2017

(65) Prior Publication Data

US 2017/0299362 A1 Oct. 19, 2017

Related U.S. Application Data

(60) Provisional application No. 62/442,193, filed on Jan. 4, 2017, provisional application No. 62/401,563, filed on Sep. 29, 2016, provisional application No. 62/316,829, filed on Apr. 1, 2016.

(51) Int. Cl.

| | |
|---|---|
| ***F42B 39/26*** | (2006.01) |
| ***A45C 13/10*** | (2006.01) |
| ***A45F 3/02*** | (2006.01) |
| ***A45C 13/18*** | (2006.01) |
| ***A45C 13/26*** | (2006.01) |
| ***B65B 5/04*** | (2006.01) |
| ***B65B 7/16*** | (2006.01) |
| ***A45C 13/02*** | (2006.01) |

(Continued)

(52) U.S. Cl.

CPC ..... *F42B 39/26* (2013.01); *A45C 13/02* (2013.01); *A45C 13/1069* (2013.01); *A45C 13/18* (2013.01); *A45C 13/20* (2013.01); *A45C 13/26* (2013.01); *A45F 3/02* (2013.01); *B65B 5/04* (2013.01); *B65B 7/16* (2013.01); *A45F 2200/0575* (2013.01); *A45F 2200/0591* (2013.01); *F42B 39/28* (2013.01)

(58) Field of Classification Search

CPC .... B65D 5/46144; B65D 5/2057; B65D 5/10; B65D 5/0254; F42B 39/02; F42B 39/26; A45F 3/02; A45F 3/06; B65B 5/04; B65B 7/16; A45C 13/18; A45C 13/02; A45C 13/1069; A45C 13/26

USPC ..... 53/441; 383/98, 99, 76, 5; 229/117.14, 229/117.24, 231, 147, 126, 151, 155; 190/101, 114, 119, 120, 902; 150/101, 150/102; 206/372, 373, 3, 818

See application file for complete search history.

(56) References Cited

U.S. PATENT DOCUMENTS 1,455,803 A * 5/1923 Nofsinger ..... F42B 39/02 224/239

2,813,669 A * 11/1957 Frieder ..... F42B 39/02 224/626

(Continued)

*Primary Examiner* — Dariush Seif

(74) *Attorney, Agent, or Firm* — Grogan, Tuccillo & Vanderleeden, LLP

(57) ABSTRACT

A carrier for storing an object is provided. The carrier includes four walls that define an interior cavity, a top-closure operative to selectively restrict access to the interior cavity, and a break-away seal. The top-closure is defined by a top panel, a center panel, a bottom panel, and two side panels. The bottom panel is fastened to the center panel so as to define two spaces between the bottom panel and the center panel. The break-away seal is operative to secure the top-closure when the top panel, center panel, bottom panel, and side panels are folded over the interior cavity with the side panels in the spaces defined by the center panel and the bottom panel.

10 Claims, 18 Drawing Sheets

(51) Int. Cl.
*A45C 13/20* (2006.01)
*F42B 39/28* (2006.01)

(56) References Cited

U.S. PATENT DOCUMENTS 2,891,715 A * 6/1959 Vineberg ..... B65D 5/46032 383/28
3,974,959 A * 8/1976 Ruda ..... B65D 5/10 383/99
4,412,619 A * 11/1983 Van Laer ..... B65D 5/46088 229/117.14
4,494,592 A * 1/1985 Bonner ..... A45C 3/00 383/40
5,265,753 A * 11/1993 Moorman ..... B65D 77/065 206/588
5,367,278 A * 11/1994 Yoshikawa ..... H01F 7/0268 335/285
5,398,871 A * 3/1995 Vescio ..... B65D 5/46008 229/117.24
6,736,309 B1 * 5/2004 Westerman ..... B65D 5/2057 229/117.05
6,874,618 B1 * 4/2005 Cragg ..... F42B 39/02 206/3
D515,588 S * 2/2006 Kirkwood ..... D14/440
2002/0181806 A1 * 12/2002 Godshaw ..... A01K 97/06 383/6
2003/0116243 A1 * 6/2003 Cooper ..... A45C 3/06 150/112
2004/0108369 A1 * 6/2004 Lo Duca ..... B65D 5/0254 229/102
2010/0006567 A1 * 1/2010 Cole ..... B65D 5/2057 219/730
2010/0089778 A1 * 4/2010 Park ..... A45C 7/0095 206/320
2011/0308047 A1 * 12/2011 Kelly ..... B65D 63/1081 24/16 PB
2012/0145718 A1 * 6/2012 Quarry ..... A45C 5/04 220/507
2013/0319213 A1 * 12/2013 Simione ..... F42B 39/26 89/34
2015/0108739 A1 * 4/2015 Kassab Arabo ..... B62B 3/00 280/651
2015/0300797 A1 * 10/2015 Akhavan ..... F42B 39/00 206/3
2016/0123700 A1 * 5/2016 Manglos ..... F42B 39/02 150/112
2016/0159515 A1 * 6/2016 Putko ..... B65D 5/6661 206/278
2017/0247162 A1 * 8/2017 Ridgeway ..... B65D 81/07
2019/0016462 A1 * 1/2019 White ..... B64D 11/0631

* cited by examiner

STORAGE SYSTEM AND METHOD

CROSS-REFERENCE TO RELATED APPLICATIONS

This application claims the benefit of U.S. Provisional Patent Application Nos. 62/316,829; 62/401,563; and 62/442,193 filed on Apr. 1, 2016, Sep. 29, 2016, and Jan. 4, 2017, respectively, which are herein incorporated by reference in their entirety.

BACKGROUND

Technical Field

Embodiments of the invention relate to storage systems and methods.

Discussion of Art

There is currently a need for a storage system or carrier that can hold magazines containing ammunition that can be securely but removably mounted to metal surfaces, such as walls or other surfaces in nuclear power plants, correctional facilities and military installations. There is also a need for carriers such as the above that can hold tools and other items for use by automotive workers, construction workers and the like. Embodiments of the invention fulfill these needs, among many others.

BRIEF DESCRIPTION

In an embodiment a carrier for storing an object is provided. The carrier includes four walls that define an interior cavity, a top-closure operative to selectively restrict access to the interior cavity, and a break-away seal. The top-closure is defined by a top panel, a center panel, a bottom panel, and two side panels. The bottom panel is fastened to the center panel so as to define two spaces between the bottom panel and the center panel. The break-away seal is operative to secure the top-closure when the top panel, center panel, bottom panel, and side panels are folded over the interior cavity with the side panels in the spaces defined by the center panel and the bottom panel.

In another embodiment a method of storing an object in a carrier is provided. The method includes placing the object in an interior cavity defined by four walls of the carrier, and restricting access to the interior cavity via a top-closure of the carrier defined by a top panel, a center panel, a bottom panel fastened to the center panel so as to define two spaces between the bottom panel and the center panel, and two side panels. The top panel, center panel, bottom panel, and side panels are folded over the interior cavity with the side panels in the spaces defined by the center panel and the bottom panel. The method further includes securing the top-closure with a break-away seal.

In yet another embodiment, another a carrier for storing an object is provided. The carrier includes a base portion configured to hold the object and having one or more material loops, and a cover portion selectively securable to the base portion and including a first strap and a second strap disposed on opposite sides of the cover portion. Each strap has at least one grommet, and the second strap is longer than the first strap. The cover portion is secured to base portion via a break-away seal that passes through the grommets and the one or more material loops.

DRAWINGS

The present invention will be better understood from reading the following description of non-limiting embodiments, with reference to the attached drawings, wherein below:

DETAILED DESCRIPTION

Figure 1:
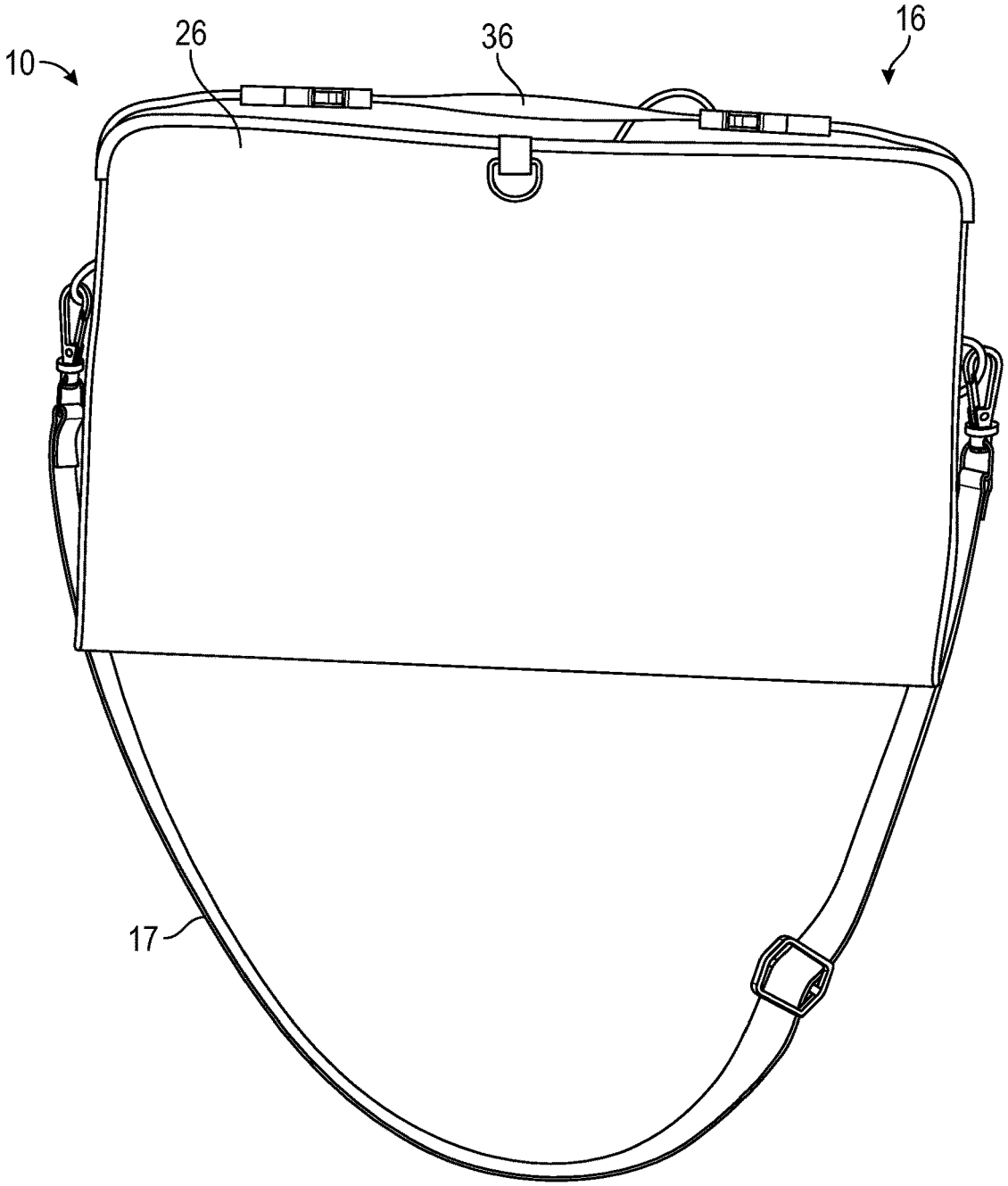
FIG. 1 is a diagram of a carrier for storing an object, in accordance with an embodiment of the present invention.

Reference will be made below in detail to exemplary embodiments of the invention, examples of which are illustrated in the accompanying drawings. Wherever possible, the same reference characters used throughout the drawings refer to the same or like parts.

Figure 2:
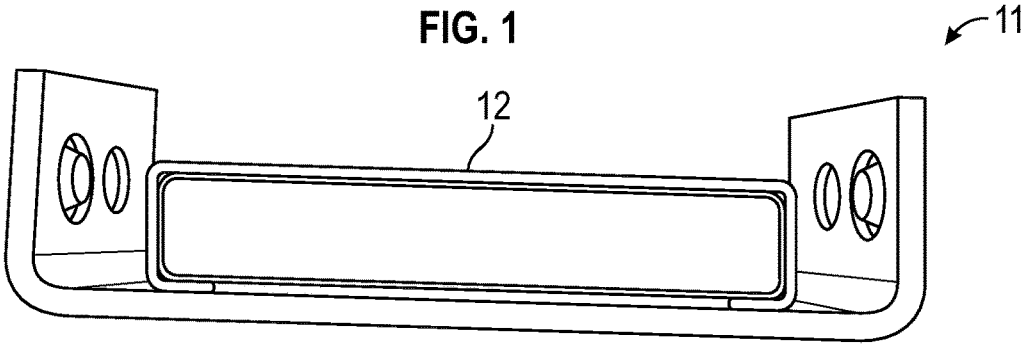
FIG. 2 is a diagram of magnet of the carrier of FIG. 1, in accordance with an embodiment of the present invention.
Figure 3:
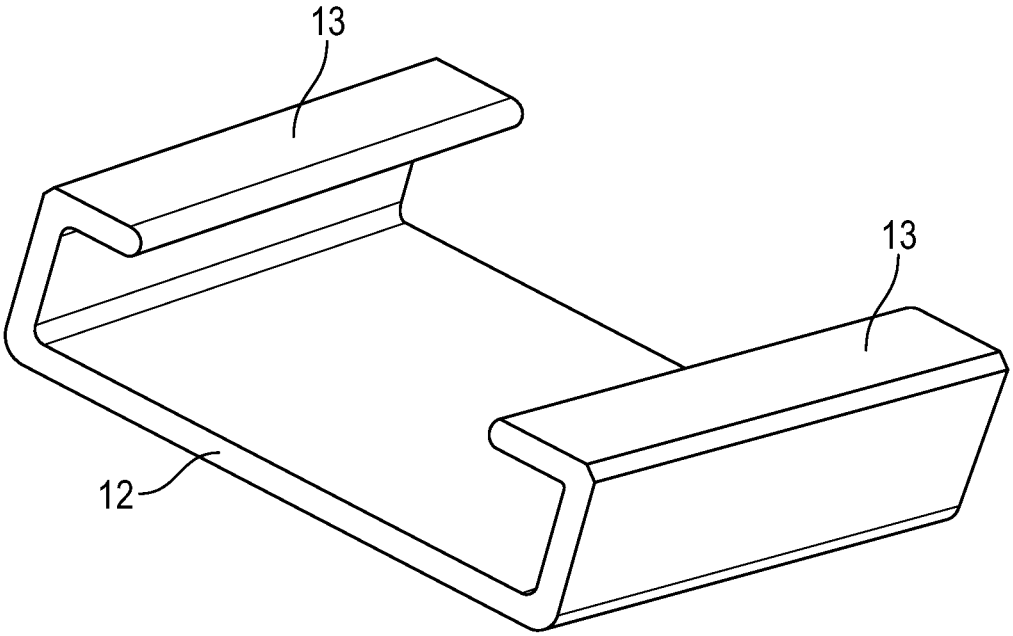
FIG. 3 is a diagram of a channel that contains the magnet of FIG. 2, in accordance with an embodiment of the present invention.
Figure 4:
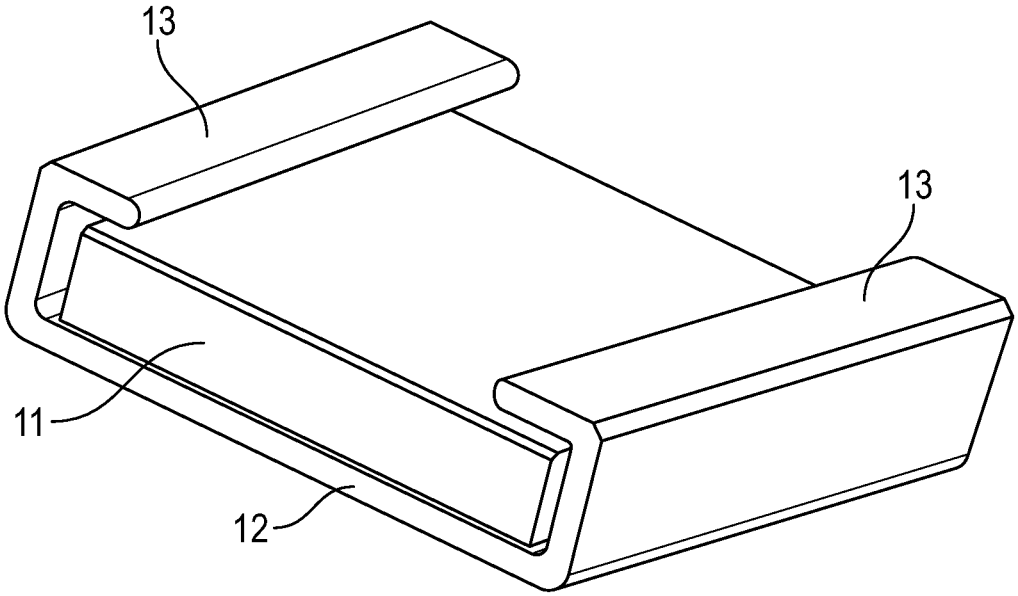
FIG. 4 is another diagram of the channel of FIG. 3, in accordance with an embodiment of the present invention.

Referring now to FIGS. 1 and 2, an embodiment of the present invention is a storage system/carrier 10 that includes a plurality of strong magnets 11, e.g., six (6) magnets, each of which are sewn into a rear-facing wall of the carrier 10. Each magnet 11 is contained within a steel channel 12 that transmits its magnetic forces through it to maintain a secure hold on the metal surface 16 that it is placed on. As such, the carrier 10 can be securely mounted on a metal wall or surface 16 thereof, for example, a ballistic wall, a defense/tactical vehicle, oil rig, or waterborne vessel, or other like surface. As shown in FIG. 1, the carrier 10 may further include a shoulder strap 17 for transporting the carrier 10 when not mounted to a surface 16.

Figure 5:
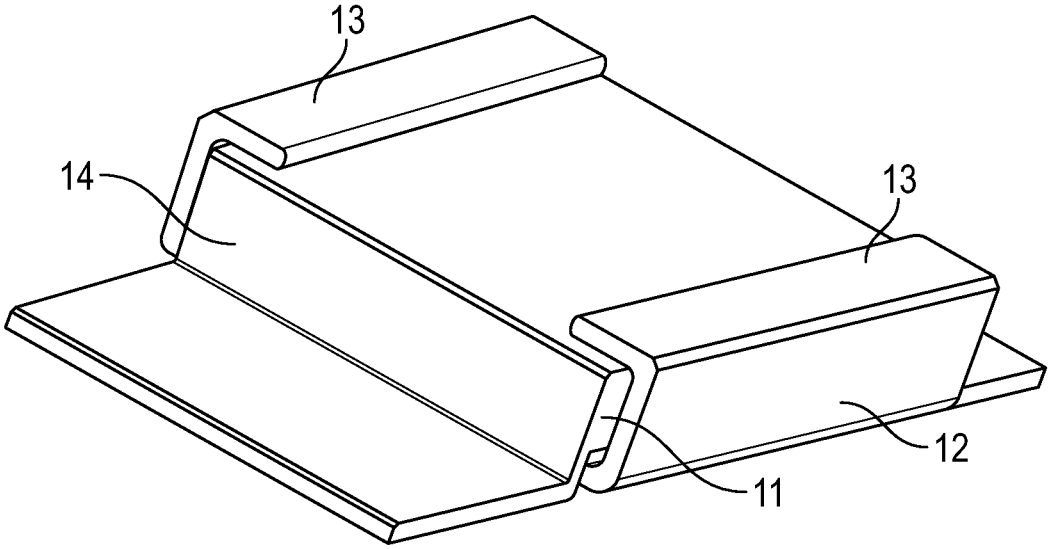
FIG. 5 is yet another diagram of the channel of FIG. 3, in accordance with an embodiment of the present invention.
Figure 6:
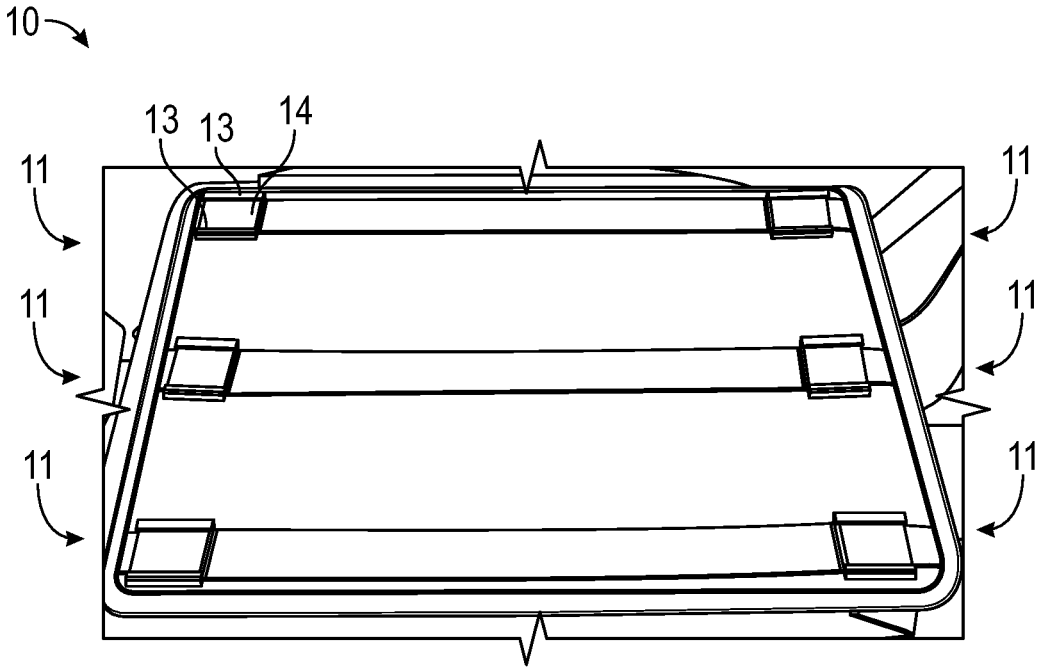
FIG. 6 is another diagram of the carrier of FIG. 1, in accordance with an embodiment of the present invention.
Figure 7:
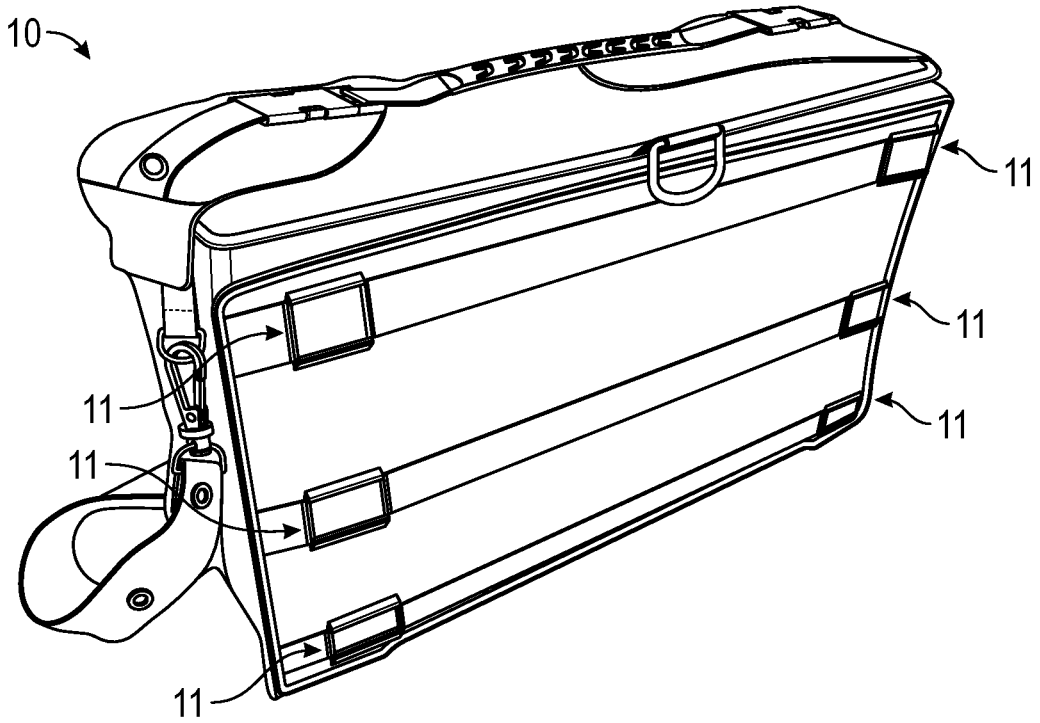
FIG. 7 is yet another diagram of the carrier of FIG. 1, in accordance with an embodiment of the present invention.

Moving to FIGS. 3-7, in embodiments, the steel channel 12 may include one or more fold-overs 13 that may hold the magnets 11 in place. As shown in FIG. 5, a fabric webbing 14 may be disposed over the magnet 11, under the fold-overs 13, and sewn into the carrier 10. For example, the carrier 10 may include six (6) magnets 11 each in a steel channel 12 having fold-overs 13, where each of the magnets 11 and steel channels 12 are retained by a webbing 14 sewn into the rear side of the carrier 10.

Figure 8:
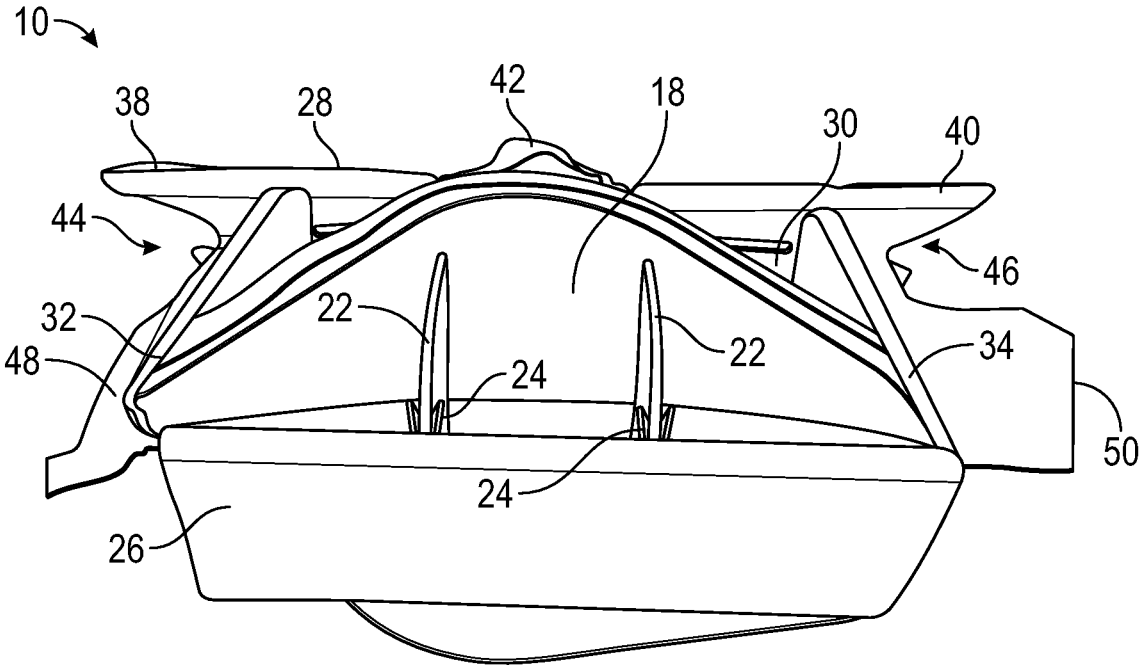
FIG. 8 is yet another diagram of the carrier of FIG. 1, in accordance with an embodiment of the present invention.
Figure 9:
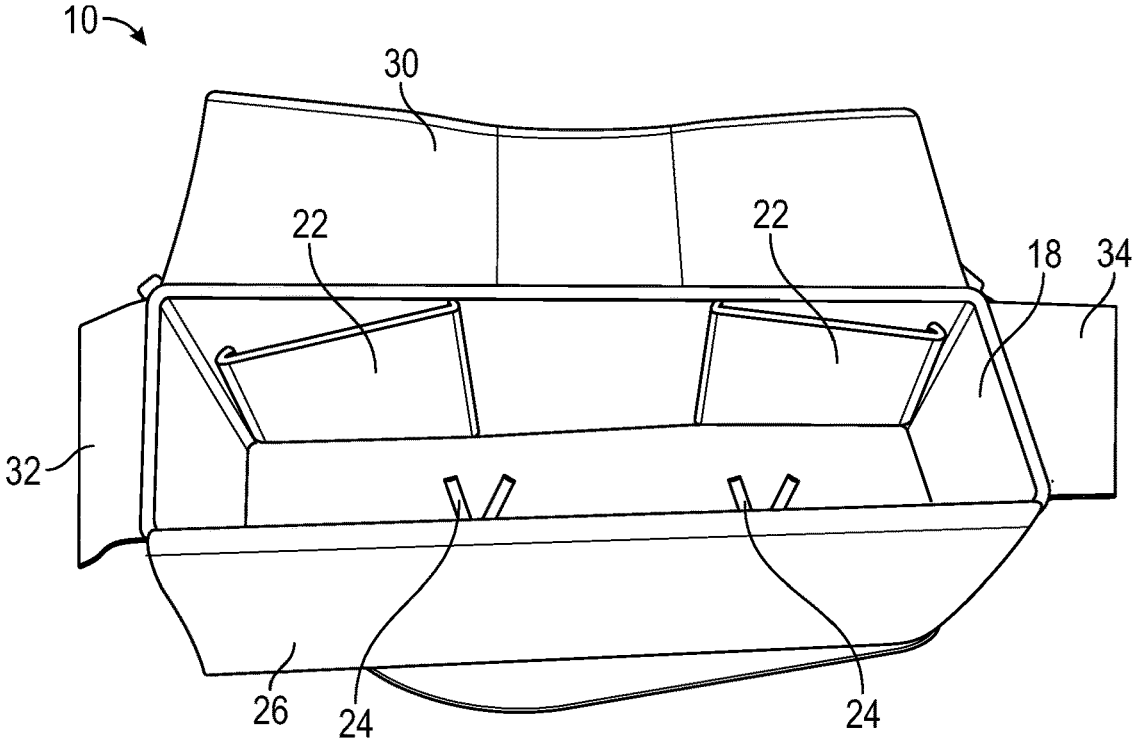
FIG. 9 is yet another diagram of the carrier of FIG. 1, in accordance with an embodiment of the present invention.
Figure 10:
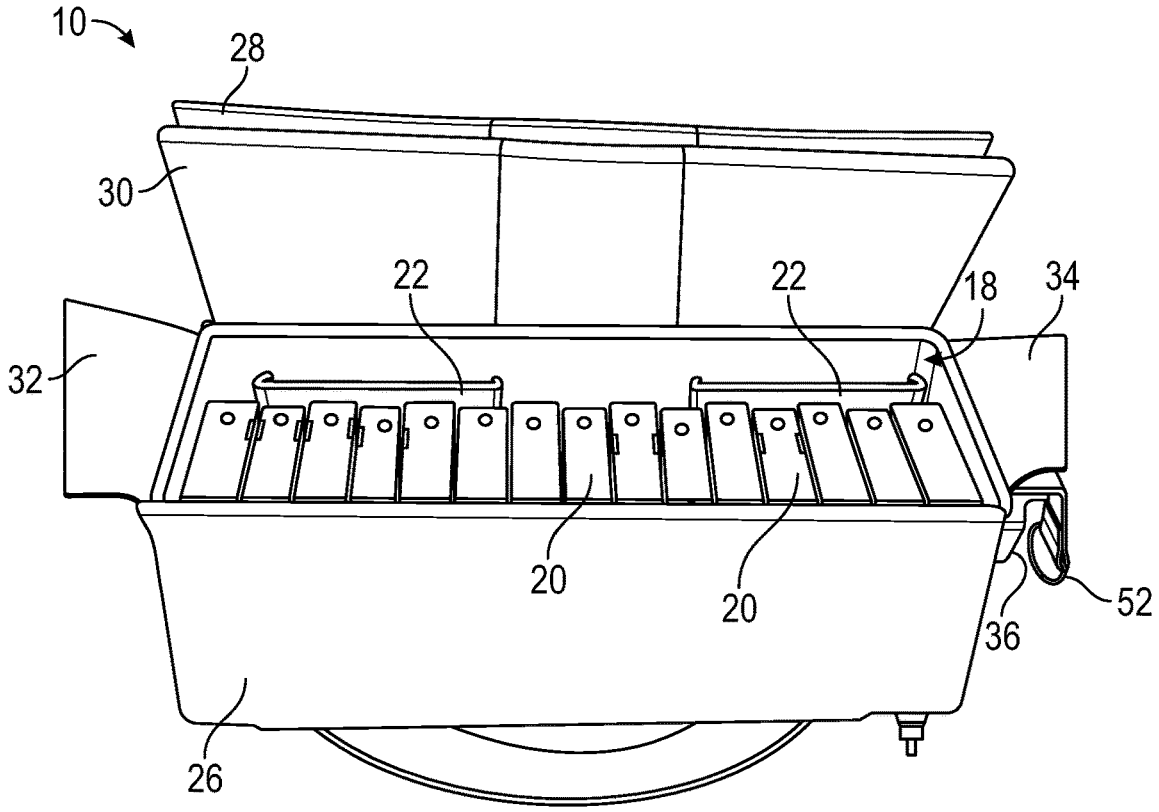
FIG. 10 is yet another diagram of the carrier of FIG. 1, in accordance with an embodiment of the present invention.

Turning now to FIGS. 8-10, The carrier 10 has an interior cavity 18 defined by four walls, and shaped and sized to accommodate one or more objects 20 (FIG. 10), e.g., ammunition magazines. For example, in embodiments, the interior cavity 18 may hold: three (3) Tac-Totes and one (1) magazine; thirteen (13) loose Magpul styled magazines; or fifteen (15) standard AR-15 styled magazines. The term Tac-Tote, as used herein, refers to an ammunition magazine carrier in accordance with the teaching of U.S. Provisional Patent Application Ser. No. 62/401,563, which is herein incorporated by reference in its entirety. In embodiments, the carrier 10 may also be sized and shaped to, for example, accommodate automotive tools or other implements. In certain aspects, the interior cavity 18 of the carrier 10 includes two fold-away walls 22 that are attached/sewn to the interior of the carrier 10 on one side, and held in place by fasteners 24, e.g., hook and loop fasteners/strips, on the other side. The fold-away walls 22 are collapsible/foldable so that the carrier 10 can be configured to house a variety of items including, but not limited to, tools, water bottles, food items, etc., in addition to ammunition magazines 20. Embodiments may further include a drainage grommet located in a bottom surface of the carrier 10, though the location may vary.

Figure 12:
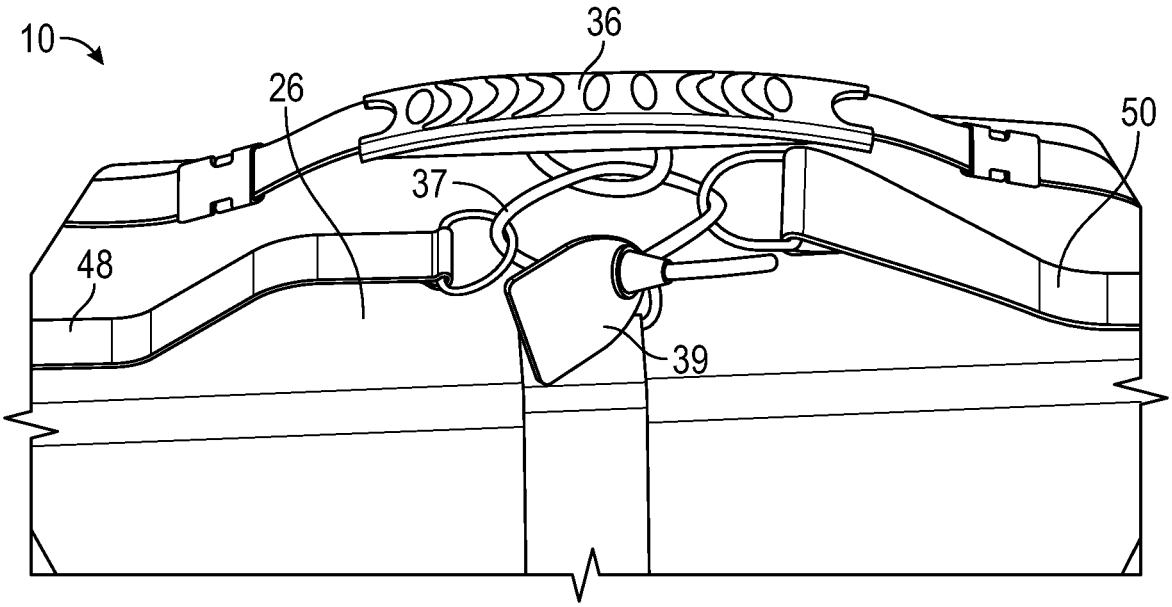
FIG. 12 is yet another diagram of the carrier of FIG. 1, in accordance with an embodiment of the present invention.

The carrier 10 includes a top panel 26, a center panel 28, a bottom panel 30, two side panels 32 and 34, and an outer/carry handle 36 (best seen in FIGS. 1 and 12). As will be appreciated, and explained in greater detail below, the panels 26, 28, 30, 32, 34 define a top-closure of the carrier 10 that, along with a break-away seal 37 (FIGS. 12 and 13), secure the carrier 10 so as to restrict tampering with the contents of the carrier 10. In embodiments, the center panel 28 has one or more magnets 11 located at the outer corners 38 and 40, and an inner handle 42. Additionally, the center panel 28 may be constructed from a series or interlocking plastic reinforced sub-panels so as to disallow access to the contents of the carrier 10 when the break-away seal 37 is secured. The bottom panel 30 is flexible and fixed/fastened to the center panel 28 such that two spaces 44 and 46 are created between the center panel 28 and the bottom panel 30, e.g., the center of the bottom panel 30 may be sewn to the center of the center panel 28, while the sides of the bottom panel 30 and of the center panel 28 are not sewn to each other.

Accordingly, the carrier 10 may be secured by folding the bottom 30, center 28, and side 32, 34 panels such that they cover the interior cavity 18 with the side panels 32, 34 folded into the spaces 44 and 46, respectively, between the bottom 30 and the center 28 panels. The top panel 26 is then folded over the center panel 28. The outer handle 36 may be formed from two straps 48 and 50 connected to the side panels 32 and 34, respectively, such that one of the straps 48 is releasably fastenable to the other strap 50, e.g., the straps 48 and 50 may form a male and female releasable buckle.

In certain embodiments, the walls of the carrier 10 and the panels 26, 28, 30, 32, and 34 themselves may have internal plastic sheets to maintain rigidity so as to prevent manipulation of the carrier 10 for the purpose of gaining access to the contents within the interior cavity 18 when the break-away seal 37 is secured.

Figure 11:
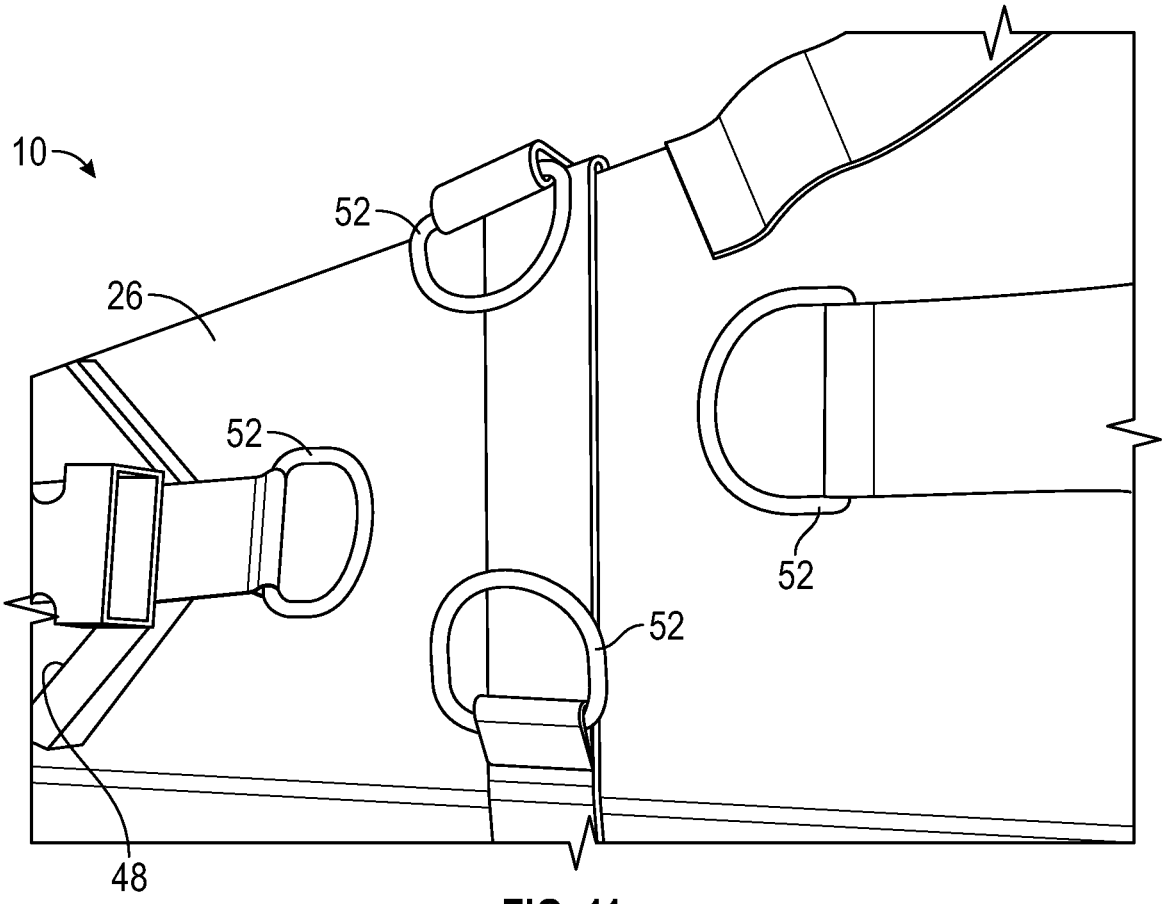
FIG. 11 is yet another diagram of the carrier of FIG. 1, in accordance with an embodiment of the present invention.
Figure 13:
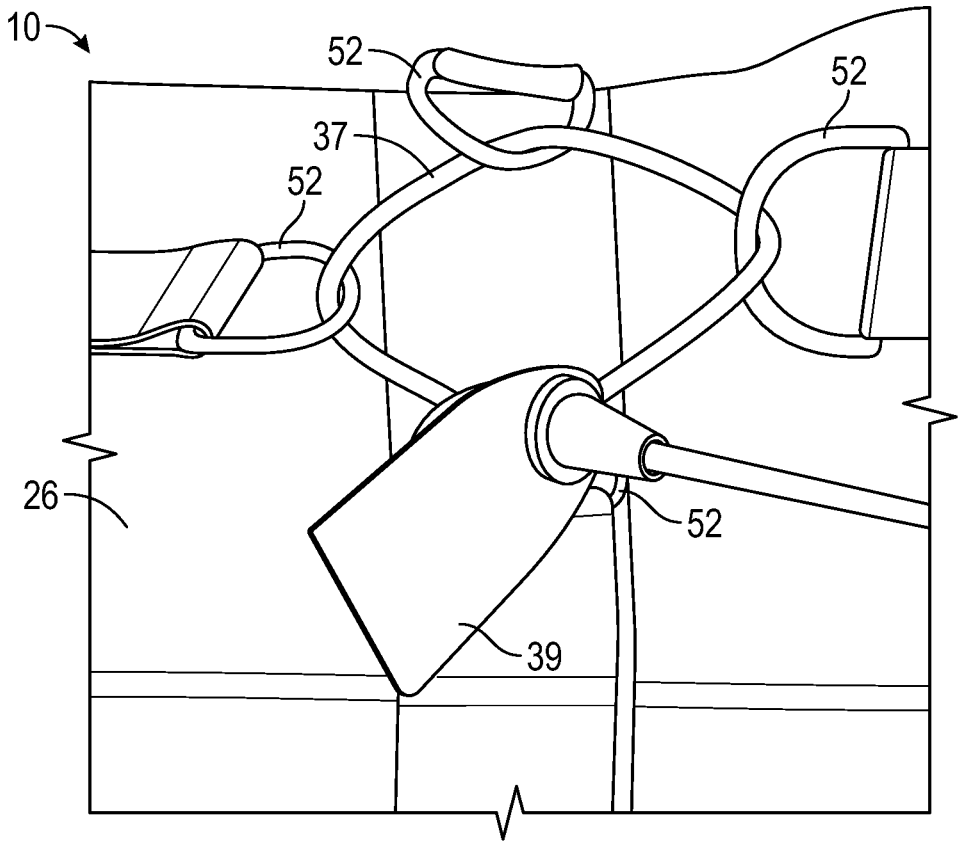
FIG. 13 is yet another diagram of the carrier of FIG. 1, in accordance with an embodiment of the present invention.

Moving to FIGS. 11-13, the top panel 26 and straps 48 and 50 may include one or more metal rings/grommets 52, e.g., four (4), through which the break-away seal 37 is passed. As shown in FIG. 13, after having been passed through metal rings 52, the break-away seal 37 may be tightened/clinched down so as to secure the top panel 26 and straps 48 and 50 in place, which in turn secures the carrier 10. As also shown in FIG. 13, the break-away seal 37 may be tightened by passing the break-away seal 37 through a securing funnel 39 such that the securing funnel 39 interlocks with one or more knobs/bumps on the break-away seal 37. In certain aspects of invention, the break-away seal 37 is passed through the larger opening to the smaller opening of the securing funnel 39, wherein the securing funnel 39 does not allow the knobs/bumps of the break-away seal 37 to be pulled in reverse, i.e., in the direction of the smaller opening to the larger opening of the securing funnel 39. As will be understood, the securing funnel 39 may form part of the break-away seal 37.

Accordingly, returning back to FIG. 1, in use during certain applications, a user will place ammunition magazines 20 into the interior cavity 18 and secure the carrier 10 by folding the panels 26, 28, 30, 32, and 34 over the interior cavity 18 in the manner described above. The user may then additionally fold the straps 48 and 50 over the top panel 26, fasten the straps 48 and 50 to each other, pass the break-away seal 37 through the metal rings 52, and then tighten the break-away seal 37 such that the carrier 10 is secured, i.e., the panels 26, 28, 30, 32, and 34 are prevented from moving to their unfolded positions. Once the break-away seal 37 is secured, the carrier 10 may be transported and/or mounted to a metal wall 16 via the magnets 11 sewn into the rear-facing wall of the carrier 10

Figure 14:
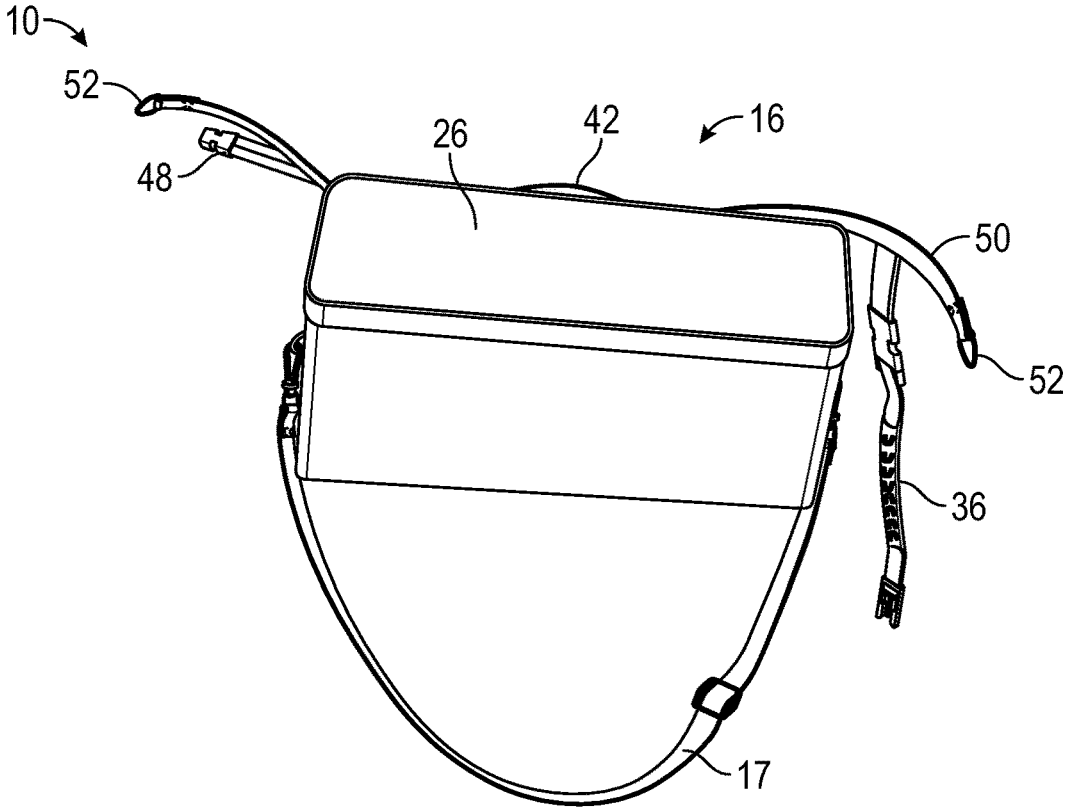
FIG. 14 is yet another diagram of the carrier of FIG. 1, in accordance with an embodiment of the present invention.
Figure 15:
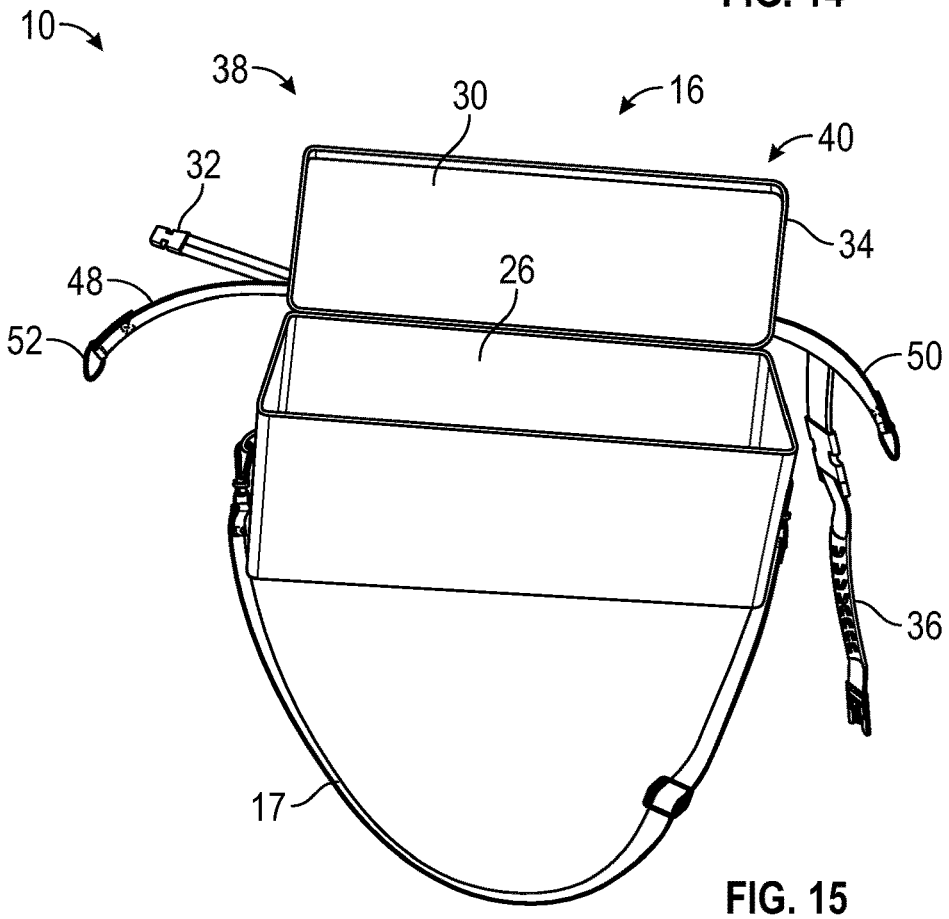
FIG. 15 is yet another diagram of the carrier of FIG. 1, in accordance with an embodiment of the present invention.

In order to access the ammunition magazines 20, a user may unsecure/release the break-away seal 37 by unfastening the straps 48 and 50 from each other with sufficient force so that the break-away seal 37 opens up, i.e., "pops open," and retracts from the metal rings 52. In other words, in embodiments, the force of opening the straps 48 and 50 overcomes the strength of the break-away seal 37 such that the break-away seal 37 breaks/snaps. For example, the break-away seal 37 may have a beaded/knobbed body wherein the break-away seal 37 snaps at the weakest beaded/knobbed portion of the body when stressed by the force of opening the straps 48 and 50. As will be understood, the user may also open the break-away seal 37 by pulling on the break-away seal 37, to include the securing funnel 39. As shown in FIG. 14, the retraction of the break-away seal 37 from the metal rings 52 allows the straps 48 and 50 to be pulled away from the top panel 26, which in turn allows the top panel 26 to be moved away from the wall 16 to its unfolded position such that the inner handle 42 is exposed. As illustrated in FIG. 15, the inner handle 42 may then be pulled towards the wall 16 so as to move the center 28, bottom 30, and side 32, 34 panels to their unfolded positions, which in turn exposes the contents in the interior cavity 18. As will be appreciated, the center 28 and bottom 30 panels may be held in place against the wall 16 via the magnets 11 located at the outer corners 38 and 40 of the center panel 28.

In embodiments, the outer handle 36 may prevent breaking of the break-away seal 37 during transportation. For example, when the carrier 10, which may weigh fifteen (15) pounds or more when fully loaded with equipment and/or ammunition magazines 20, is lifted/supported via the outer handle 36, two or more of the metal rings 52 on the top panel 26 move towards each other so as to reduce the stress on the break-away seal 37 without compromising the security provided by the break-away seal 37, e.g., prevention of accidental breakage/popping open of the break-away seal 37.

Figure 16:
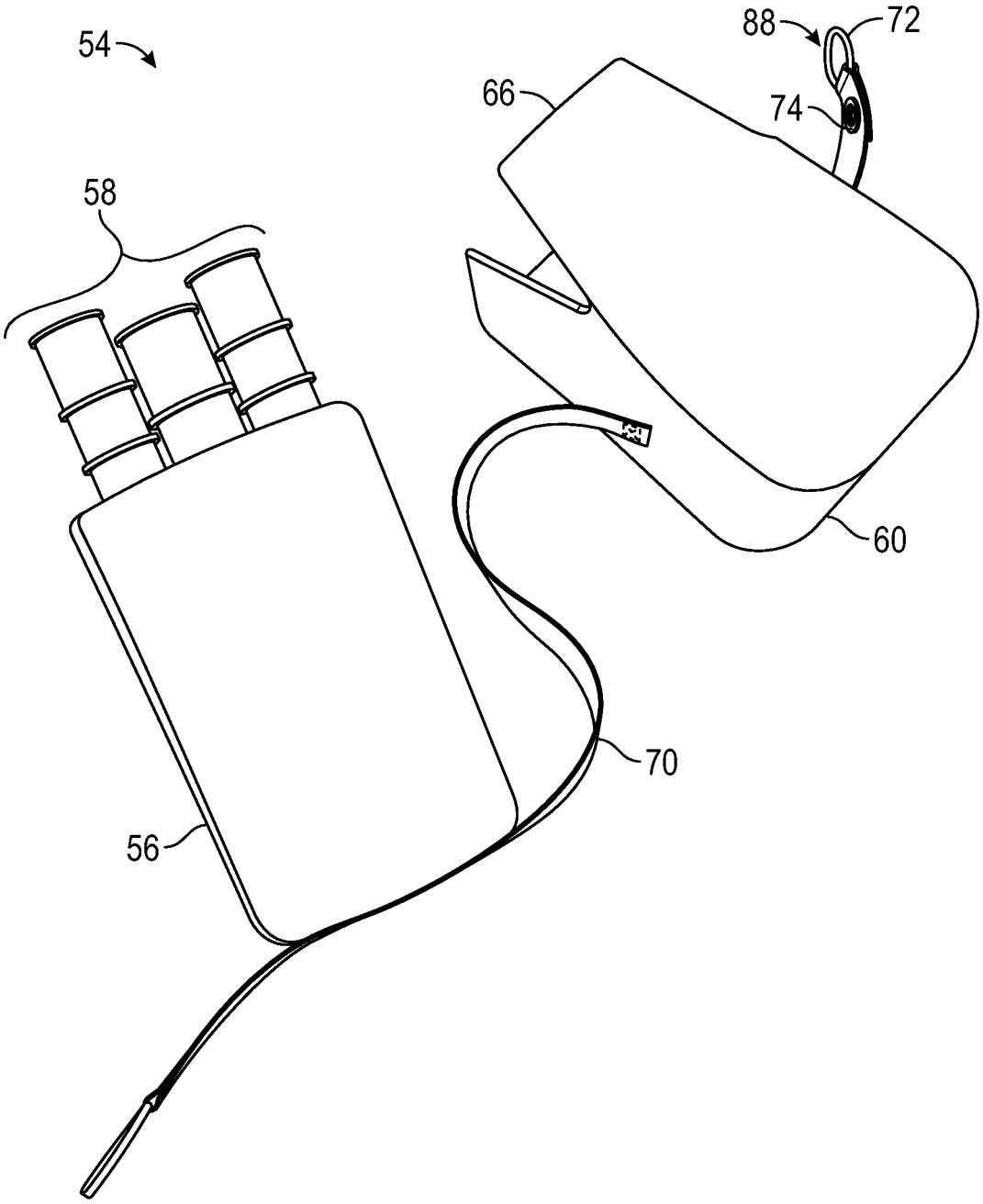
FIG. 16 is a diagram of another carrier for storing an object, in accordance with an embodiment of the present invention.
Figure 17:
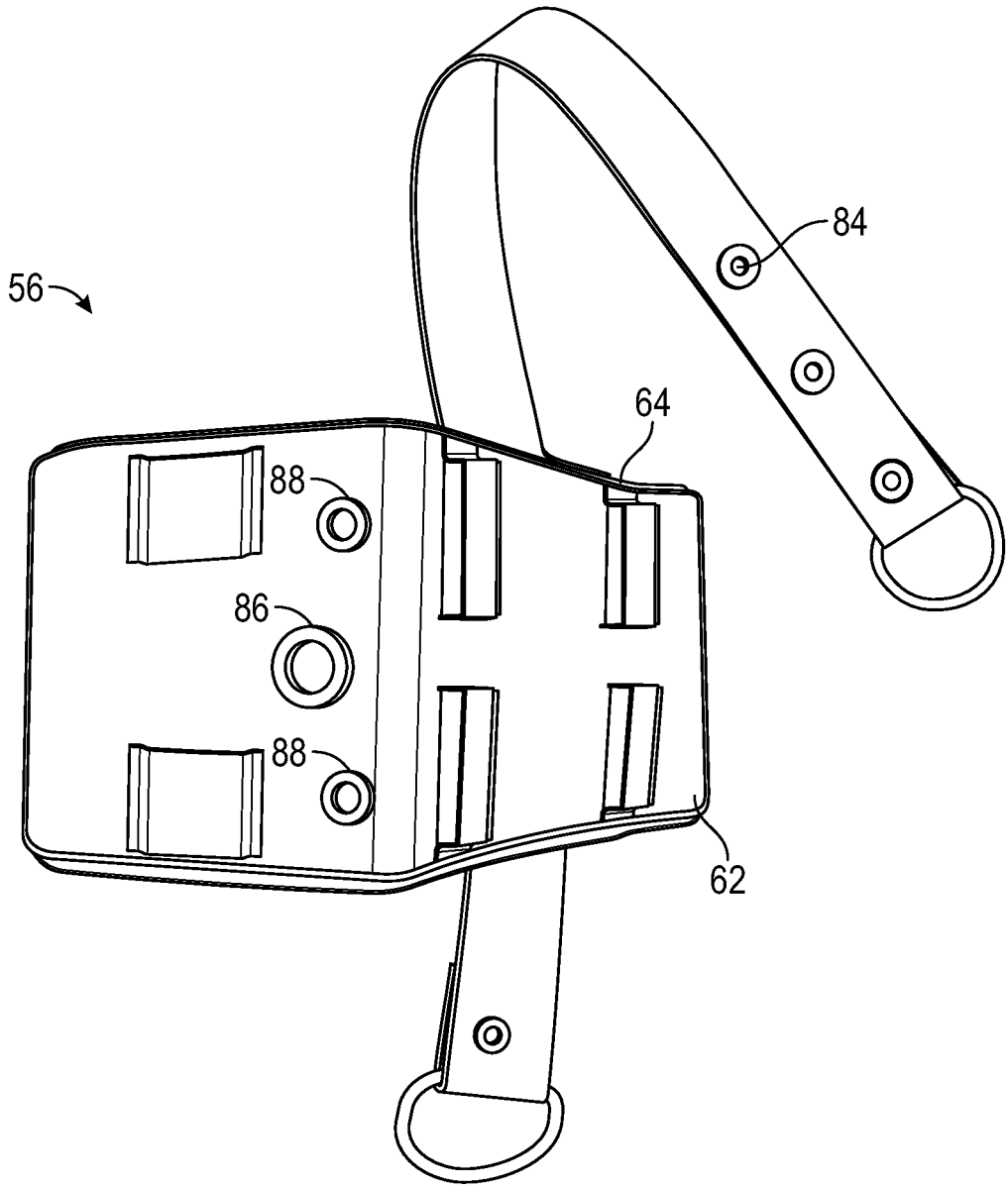
FIG. 17 is a diagram of a base portion of the carrier of FIG. 16, in accordance with an embodiment of the present invention.
Figure 18:
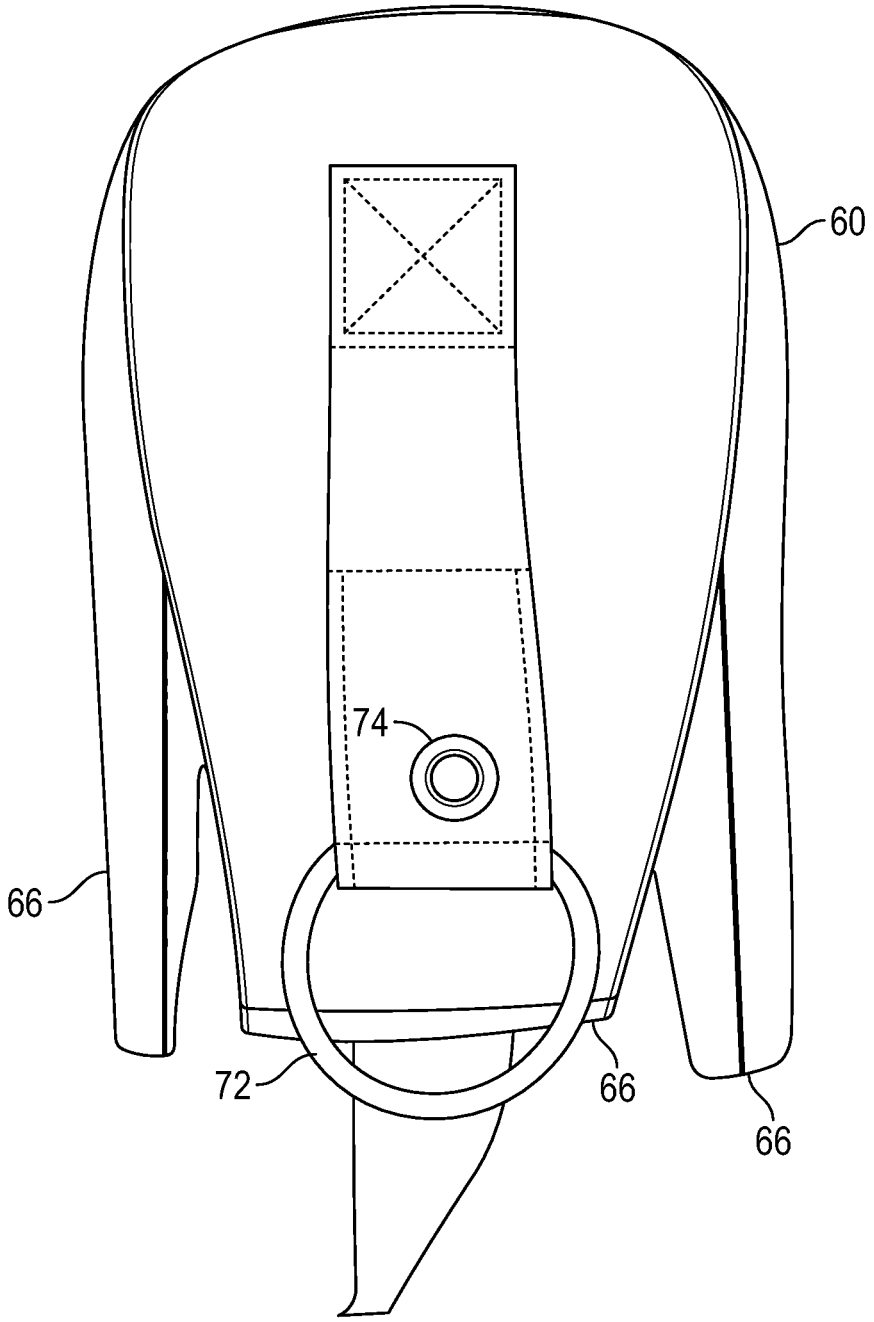
FIG. 18 is a diagram of a cover portion of the carrier of FIG. 16, in accordance with an embodiment of the present invention.
Figure 19:
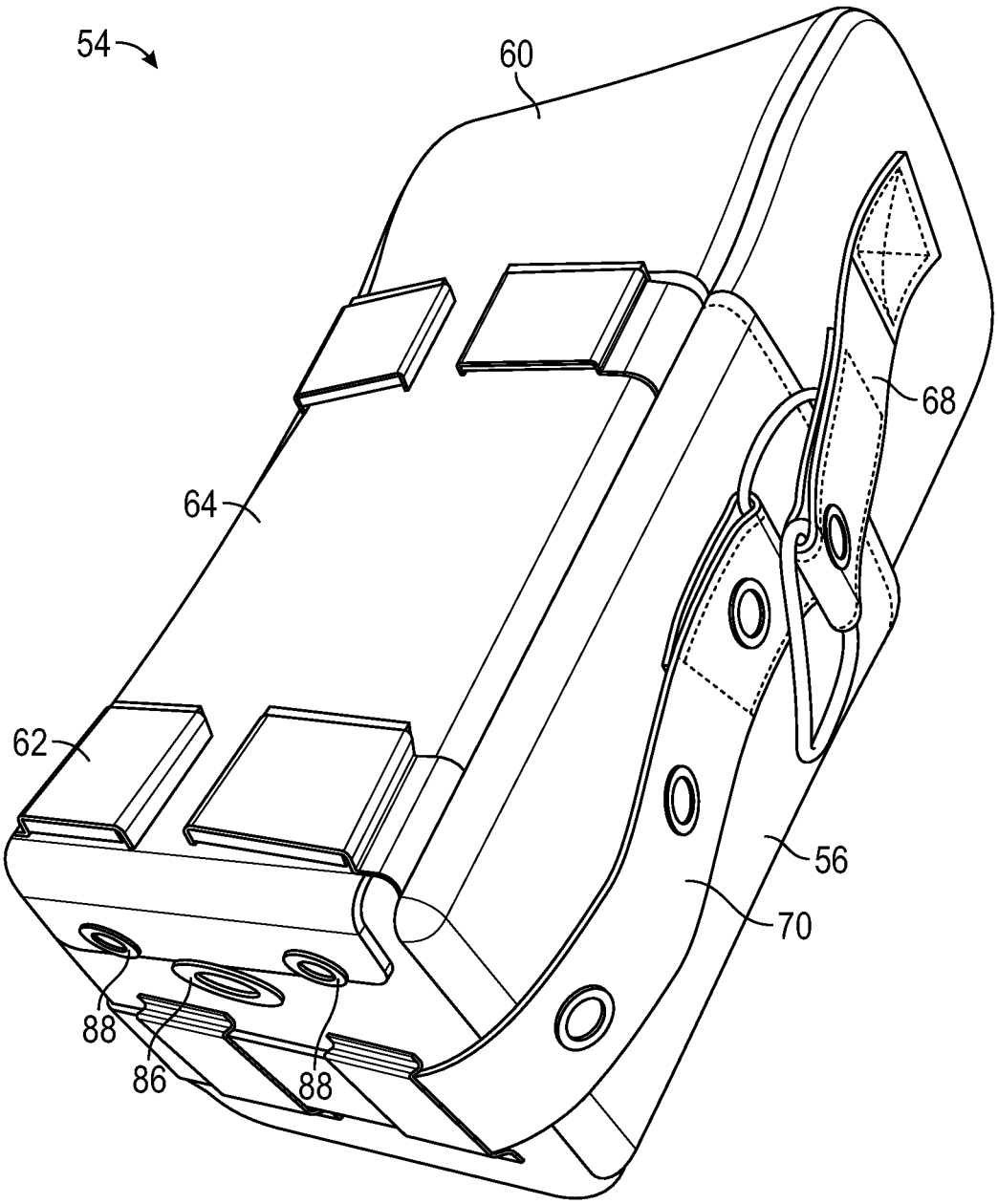
FIG. 19 is yet another diagram of the carrier of FIG. 16, in accordance with an embodiment of the present invention.

Referring now to FIGS. 16-18, another embodiment of a storage system/carrier 54 includes base portion or pouch 56 configured to hold, for example, three ammunition containing magazines 58, as well as a cover portion 60. The base portion 56 has four relatively strong outward facing magnets 62 (best seen in FIG. 17) sewn into its rear wall 64. The cover portion 60 is selectively securable to the base portion 56 to enclose the contents, e.g., the three magazines 58, from the top down. The cover portion 60 is configured to extend into the base portion 56 approximately two inches in certain embodiments. As shown, the cover portion 60 may include a series of movable/pivotable walls 66, e.g., (best seen in FIG. 18), that facilitate insertion and extension into the base portion 56.

As shown in FIG. 16, the cover portion 60 includes two straps 68, 70. The shorter of the straps 68, includes a loop 72 and a grommet 74. The grommet 74 is configured to accept a seal (not shown) and the loop 72 allows a user to break the seal and pull the cover 60 off/away from the base portion 56. The side of the cover portion 60 opposite the side to which strap 68 is fastened has the longer strap 70 that travels down the side of the base portion 56, under the base portion 56, and up the other side meeting with the shorter strap 68, as best seen in FIGS. 16, and 19-22.

Figure 20:
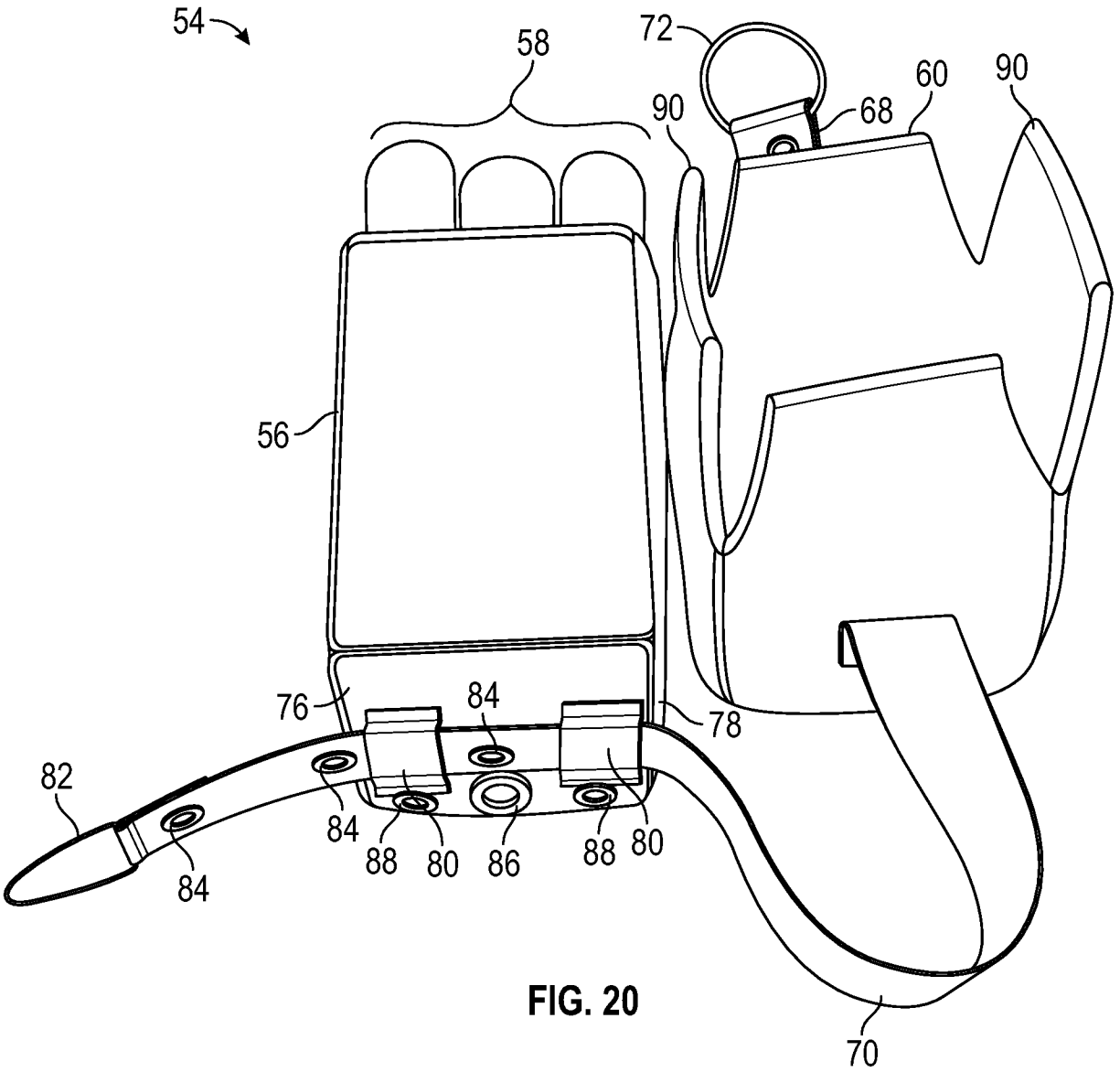
FIG. 20 is yet another diagram of the carrier of FIG. 16, in accordance with an embodiment of the present invention.
Figure 21:
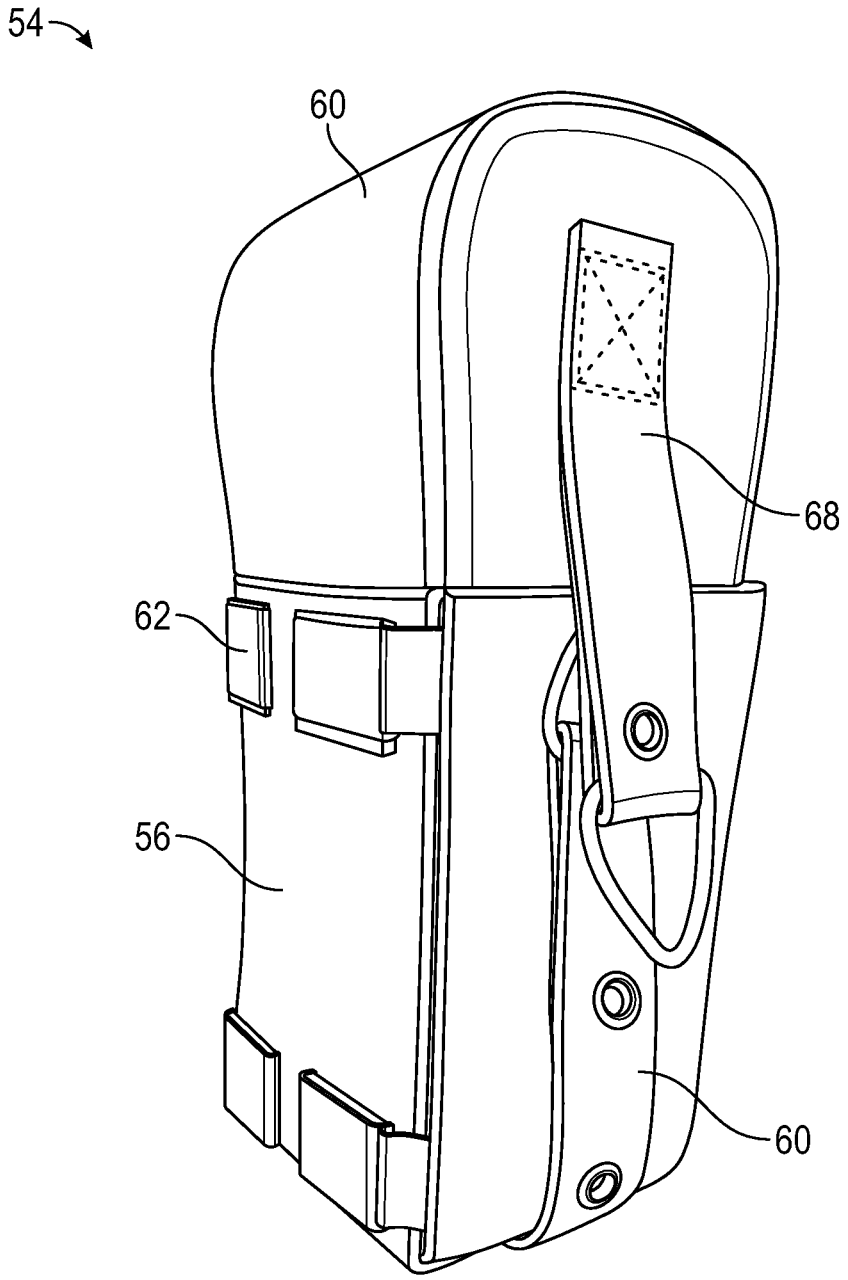
FIG. 21 is yet another diagram of the carrier of FIG. 16, in accordance with an embodiment of the present invention.
Figure 22:
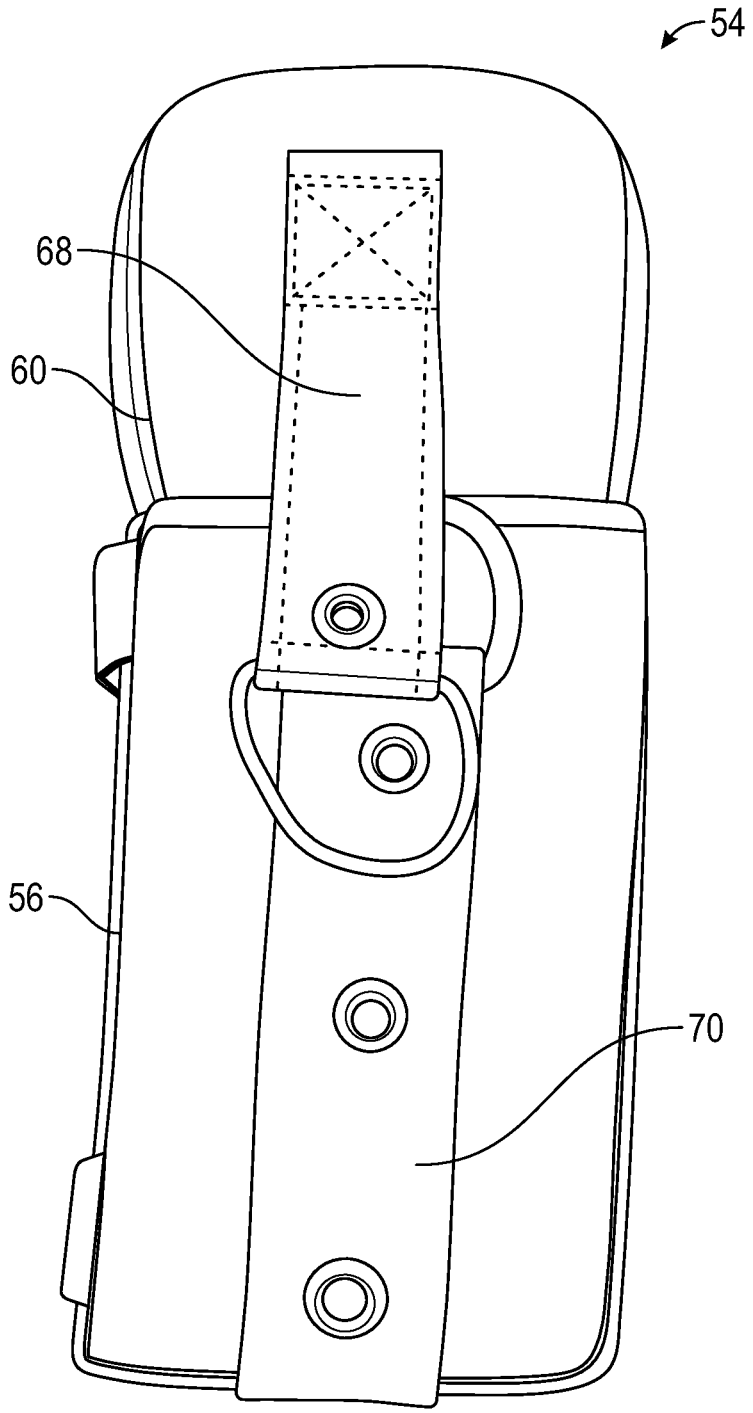
FIG. 22 is yet another diagram of the carrier of FIG. 16, in accordance with an embodiment of the present invention.
Figure 23:
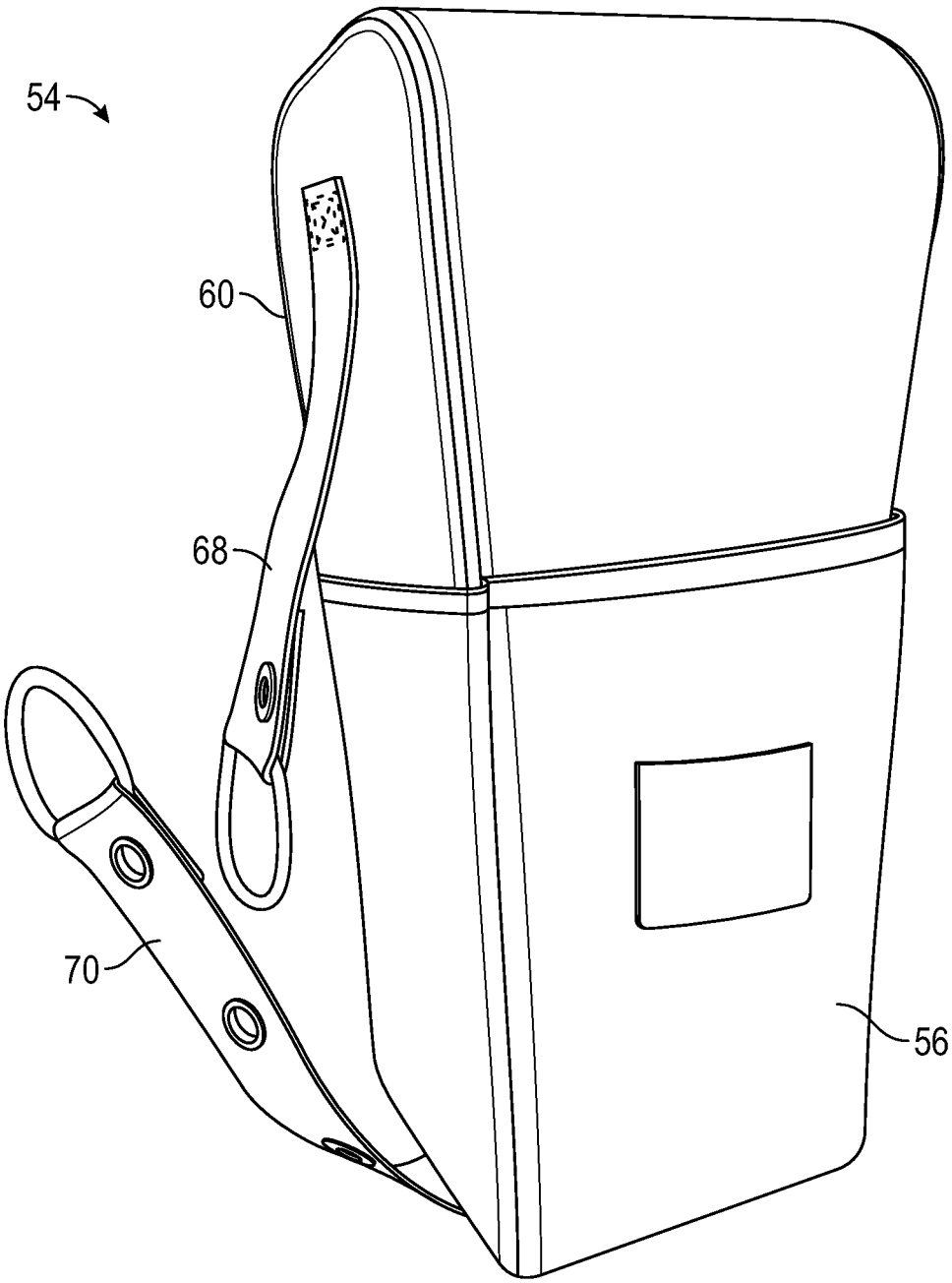
FIG. 23 is yet another diagram of the carrier of FIG. 16, in accordance with an embodiment of the present invention.
Figure 24:
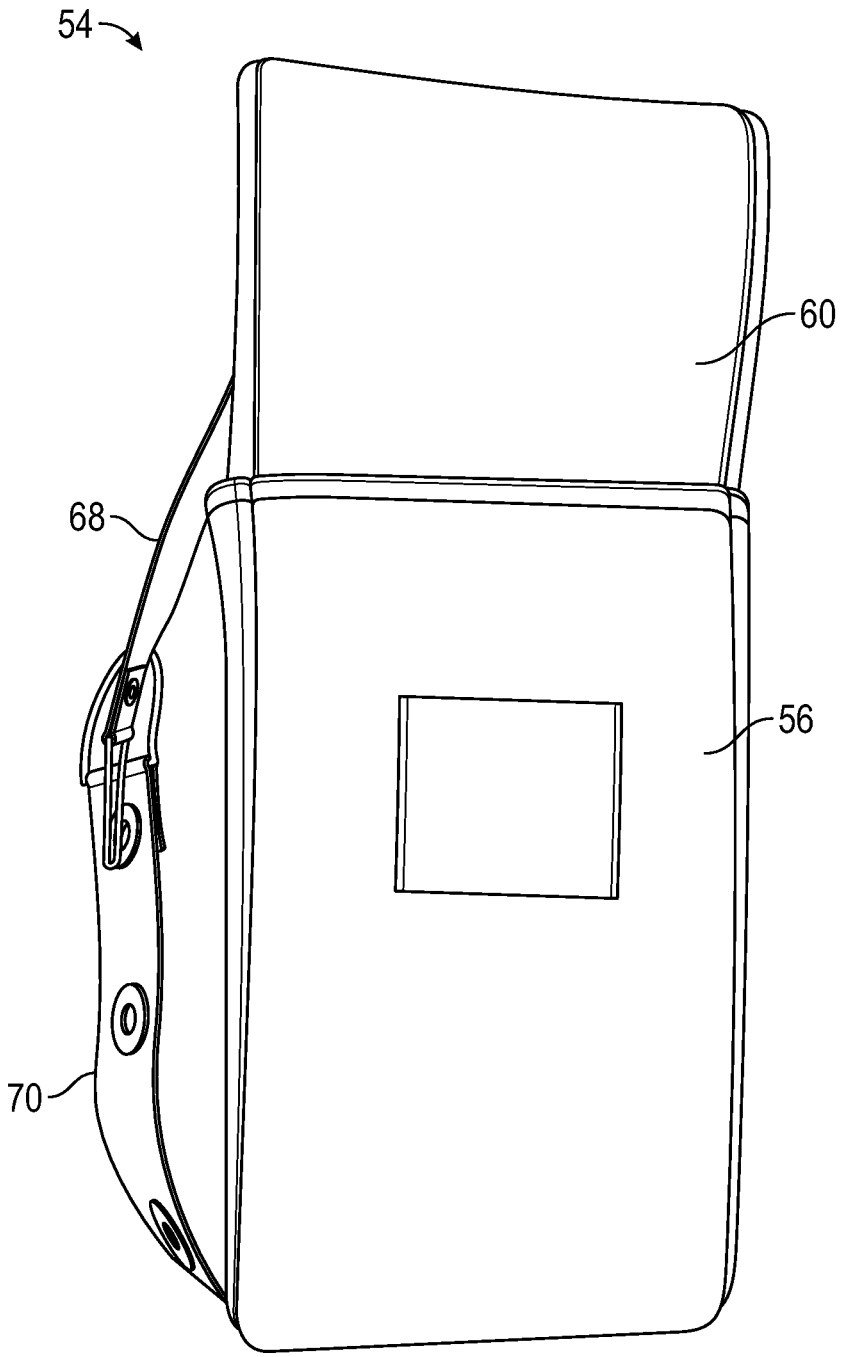
FIG. 24 is yet another diagram of the carrier of FIG. 16, in accordance with an embodiment of the present invention.
Figure 25:
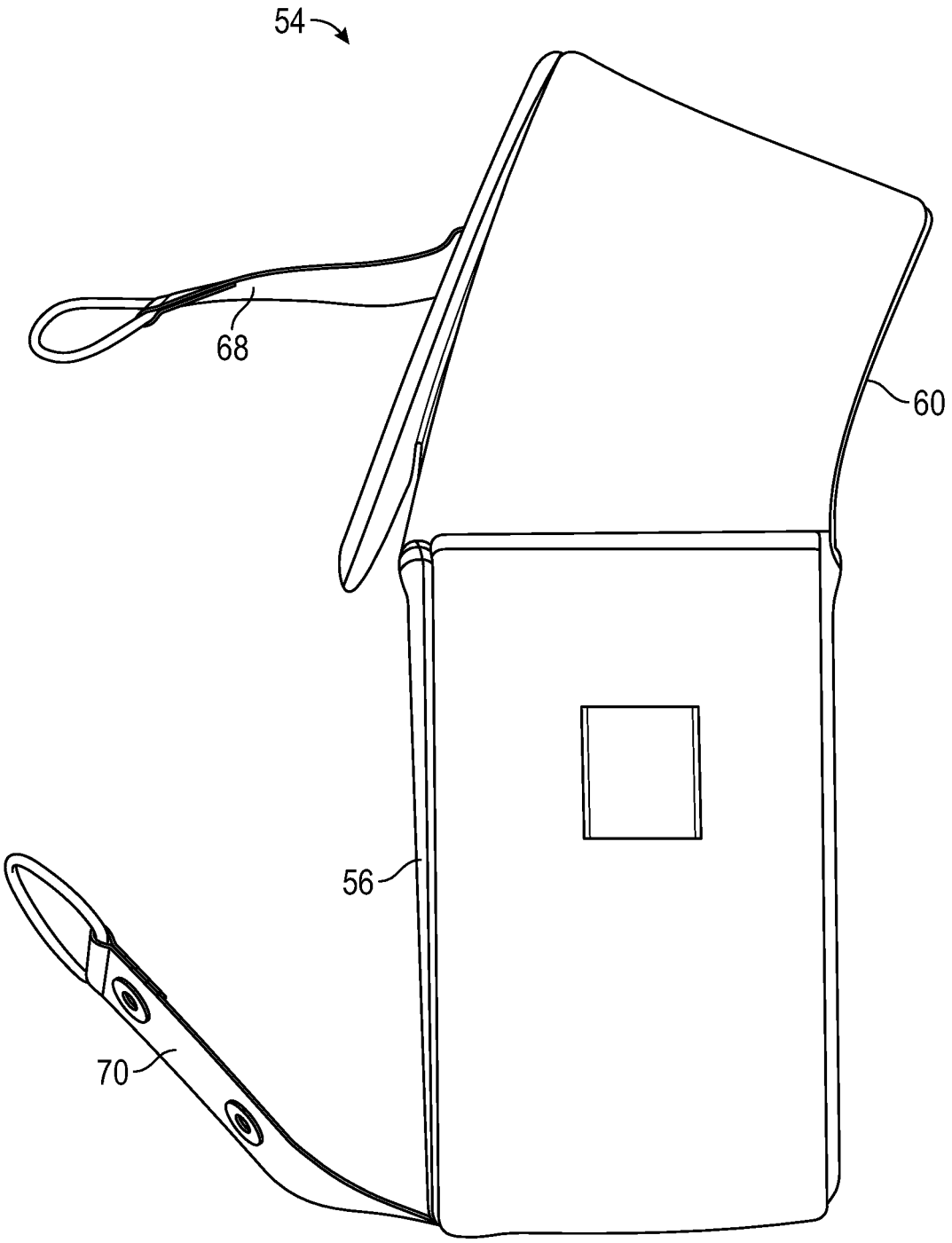
FIG. 25 is yet another diagram of the carrier of FIG. 16, in accordance with an embodiment of the present invention.

Turning now to FIG. 20, to facilitate securing of the cover portion 60 to the base portion 56, as well as the quick-action release of the cover 60 from the base 56, the bottom 76 and right side 78 of the body/base portion 56 have at least one material loop 80 secured thereto such that the longer cover strap 70 extends through to prevent manipulation of the strap 70 from movement.

The longer strap 70 has a loop 82 and a plurality of grommets 84, e.g., three, for the seal to run through (length of seal used will vary thus there are numerous grommets). At the base of the main pouch are an additional series of grommets 86, 88. In an embodiment, the grommets include one large grommet 86 and two small grommets 88. These are used as windows in order to visually confirm the magazines are located inside. As will be appreciated, the number of grommets 86, 88 may vary as long as the functionality of the same is maintained.

In certain embodiments, the walls of both the cover 60 and main body portion 56, (excepting the rear of the main body 56), have internal plastic sheets to maintain rigidity and prevent manipulation of the material to gain access to the contents.

Referring now to FIGS. 16, and 21-25, in use, in certain applications, a user will place the three magazines 58 into the main body portion 56. The user will thread the longer cover strap 70 through the three material loops 80 on the outside of the main body portion 56. The user will then place the cover 60 over the top of the magazines 58 and push it down capturing the magazines 58 inside. The user will insure that each side 66 of the cover 60 travels inside the main body portion 56 by pushing until the cover 60 cannot travel any further. The user will then bring the two straps 68, 70 together and pull them tightly in preparation for seal placement.

At this point, the user will thread a control seal (not shown) through both straps 68, 70 using the best option of the grommets located on each strap 68, 70. Once the seal is taut, the carrier 54 is now ready for placement at a desired location, e.g., at or onto locations that have steel material for the magnets 62 to adhere too.

It is further to be understood that the above description is intended to be illustrative, and not restrictive. For example, the above-described embodiments (and/or aspects thereof) may be used in combination with each other. Additionally, many modifications may be made to adapt a particular situation or material to the teachings of the invention without departing from its scope.

For example, in an embodiment a carrier for storing an object is provided. The carrier includes four walls that define an interior cavity, a top-closure operative to selectively restrict access to the interior cavity, and a break-away seal. The top-closure is defined by a top panel, a center panel, a bottom panel, and two side panels. The bottom panel is fastened to the center panel so as to define two spaces between the bottom panel and the center panel. The break-away seal is operative to secure the top-closure when the top panel, center panel, bottom panel, and side panels are folded over the interior cavity with the side panels in the spaces defined by the center panel and the bottom panel. In certain embodiments, the center panel includes an inner handle. In certain embodiments, the carrier further includes an outer handle fastened to the top-closure. In certain embodiments, the outer handle is formed from two straps fastened to the side panels. In certain embodiments, the top panel includes one or more grommets through which the break-away seal passes when securing the top-closure. In certain embodiments, the break-away seal is operative to be passed through a securing funnel that provides for the break-away seal to be tightened against the top-closure. In certain embodiments, the carrier further includes one or more magnets fastened to at least one of the four walls. In certain embodiments, the carrier further includes one or more magnets fastened to the center panel. In certain embodiments, the carrier further includes one or more fold-away walls disposed within the interior cavity. In certain embodiments, the carrier further includes a drainage grommet disposed in a one of the four walls.

Other embodiments provide for a method of storing an object in a carrier. The method includes placing the object in an interior cavity defined by four walls of the carrier, and restricting access to the interior cavity via a top-closure of the carrier defined by a top panel, a center panel, a bottom panel fastened to the center panel so as to define two spaces between the bottom panel and the center panel, and two side panels. The top panel, center panel, bottom panel, and side panels are folded over the interior cavity with the side panels in the spaces defined by the center panel and the bottom panel. The method further includes securing the top-closure with a break-away seal. In certain embodiments, the center panel includes an inner handle. In certain embodiments, the carrier includes an outer handle fastened to the top-closure.

In certain embodiments, the outer handle is formed from two straps fastened to the side panels. In certain embodiments, securing the top-closure with a break-away seal includes passing the break-away seal through one or more grommets disposed within the top panel. In certain embodiments, securing the top-closure with a break-away seal further includes tightening the break-away seal via a securing funnel. In certain embodiments, the method further includes fixing the carrier to a metal wall via one or more magnets disposed in at least one of the four walls. In certain embodiments, the method further includes accessing the object via breaking the break-away seal and opening the top-closure.

Yet still other embodiments provide for a carrier for storing an object. The carrier includes a base portion configured to hold the object and having one or more material loops, and a cover portion selectively securable to the base portion and including a first strap and a second strap disposed on opposite sides of the cover portion. Each strap has at least one grommet, and the second strap is longer than the first strap. The cover portion is secured to base portion via a break-away seal that passes through the grommets and the one or more material loops. In certain embodiments, the second strap further has a loop through which the break-away seal is passed, and the loop facilitates breaking of the break-away seal.

Thus, as will be appreciated, some embodiments of the present invention provide for a storage system/carrier that is readily mountable to a variety of metal surfaces while securing storing ammunition. Further, the shoulder strap of some embodiments provides for the ability to transport the carrier without risking accidental release of the break-away seal. As such, embodiment of the invention may provide for ammunition and/or other equipment to be securely pre-staged at appropriate/critical locations in support of combat and/or other emergency operations. Further, embodiments of the invention may provide for service technicians to securely store equipment underneath vehicles. Additionally, embodiments of the invention may provide for maintenance/construction crews to securely store tools at a site of operation, e.g., an office or construction site. As such, some embodiments of the invention may provide for a carrier that securely stores thirty-three magazines, as well as several pieces of response gear, e.g., a gas mask with canister, two or more magazine carriers, a chemical agent unit, and/or a backup radio.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted based on 35 U.S.C. § 122, sixth paragraph, unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described invention, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A carrier for storing an object comprising:

a plurality of walls that define an interior cavity;

a top-closure operative to selectively restrict access to the interior cavity of the carrier, the top-closure comprising:

a center panel and a bottom panel, the center panel and bottom panels being fastened together at their respective centers while side portions of the panels are not fastened together creating spaces on opposing ends of the fastened center and bottom panels;

and two side panels configured for insertion into the spaces between the fastened center and bottom panels; and a top panel configured to fold over the center, bottom and side panels, when the side panels are inserted into the spaces between the center and bottom panels; and a securing mechanism; and wherein the securing mechanism is operative to secure the top-closure when the top panel, center panel, bottom panel, and side panels are folded over the interior cavity with the side panels in the spaces defined by the center panel and the bottom panel.

2. The carrier of claim 1, wherein the center panel includes an inner handle.

3. The carrier of claim 1 further comprising:

an outer handle fastened to the top-closure.

4. The carrier of claim 3, wherein the outer handle is formed from two straps fastened to the side panels.

5. The carrier of claim 1, wherein the securing mechanism includes one or more grommets or rings on the top panel through which a break-away seal may pass to secure the top-closure.

6. The carrier of claim 5, wherein the break-away seal is operative to be passed through a securing funnel that provides for the break-away seal to be tightened against the top-closure.

7. The carrier of claim 1 further comprising:

one or more magnets fastened to at least one of the plurality of walls.

8. The carrier of claim 1 further comprising:

one or more magnets fastened to the center panel.

9. The carrier of claim 1 further comprising:

one or more fold-away walls disposed within the interior cavity.

10. The carrier of claim 1 further comprising:

a drainage grommet disposed in one of the plurality of walls.

* * * * *